United States Patent [19]

Stachejko

[11] 4,105,959

[45] Aug. 8, 1978

[54] AMPLITUDE BALANCED DIODE PHASE SHIFTER

[75] Inventor: Vitaly Stachejko, Willingboro, N.J.

[73] Assignee: RCA Corporation, New York, N.Y.

[21] Appl. No.: 811,290

[22] Filed: Jun. 29, 1977

[51] Int. Cl.[2] ..... H01P 3/08; H01P 1/18; H01P 1/22

[52] U.S. Cl. ..... 333/31 R; 333/11; 333/84 M

[58] Field of Search ..... 333/31 R, 11, 84 M, 333/84 R, 7 D, 81 A, 1, 6, 31 A, 33, 35; 343/778, 854

[56] References Cited

U.S. PATENT DOCUMENTS

| | | | |
|---|---|---|---|
| 3,400,405 | 9/1968 | Patterson, Jr. | 333/11 X |
| 3,422,378 | 1/1969 | La Rosa | 333/31 R X |
| 3,571,762 | 3/1971 | Smilen | 333/84 M X |
| 3,585,533 | 6/1971 | Denhard | 333/81 A |

*Primary Examiner*—Alfred E. Smith
*Assistant Examiner*—Marvin Nussbaum
*Attorney, Agent, or Firm*—H. Christoffersen; Robert M. Rodrick; Joseph D. Lazar

[57] ABSTRACT

A hybrid coupled phase shifter for introducing a predetermined phase shift in a microwave frequency signal includes a four port transmission line network. RF input and output terminals are connected to two of the ports and a pair of PIN diodes connected to the other ports. The diodes are biased from a conducting to a nonconducting state to provide a reflective phase shift in the microwave signal. Highly resistive material is suitably disposed on the transmission lines such that at the diode conducting state the resistive material is decoupled from the RF power and coupled at the diode non-conducting state to a predetermined value to thereby balance the insertion loss between the diode switching states.

6 Claims, 2 Drawing Figures

AMPLITUDE BALANCED DIODE PHASE SHIFTER

The Government has rights in this invention pursuant to Contract No. N00017-70-C-2403 awarded by the Department of the Navy.

BACKGROUND OF THE INVENTION

1. Field of the Invention

This invention relates to a microwave phase shifter and more particularly to a hybrid coupled diode phase shifter having substantially equal values of insertion loss as the diode is switched from conducting to nonconducting states.

2. Description of the Prior Art

A microwave phase shifter is a device that is capable of changing its electrical length (insertion loss) in a predictable manner in response to a proper command signal. One of the primary applications for a microwave phase shifter is an phased array radar systems. In such phased array radar systems, the electrical length of transmission lines interconnecting parts of the system is critical. For purposes of regulating the phase of the transmitted signals in these radar systems the electrical length of the transmission lines from transmitting equipment to the several radiating elements in the antenna array must be substantially equal. A typical radar system requires, for example, several antenna systems and thousands of phase shifters. By controlling the electricl length of these phase shifters, the radar beam can be made to point in any desired direction, and this direction can be changed several thousand times per second.

Microwave phase shifters can be fabricated using either diodes or ferrites as the switched material and either can be used in coaxial, stripline, microstrip or waveguide construction. Several types of diode phase shifters have been devised such as switched line, hybrid coupled, loaded line and three element "$\pi$" or "T" circuits. In particular, the hybrid coupled circuit includes a 3-decibel (db)-quadrature hybrid with a pair of balanced diode switches connected to identical split arms of the hybrid. The hybrid coupled bit is used extensively because it achieves larger phase shifts while using only two diodes. The following references describe diode phase shifters and are indicative of the present state of the art: U.S. Pat. No. 3,571,762 issued Mar. 23, 1971; U.S. Pat. No. 3,400,405 issued Sept. 3, 1968; U.S. Pat. No. 3,454,906 issued July 8, 1969; U.S. Pat. No. 3,982,214 issued Sept. 21, 1976; J. F. White, "Diode Phase Shifters for Array Antennas," IEEE Transactions on Microwave Theory and Techniques, Vol. MTT-22, No. 6, June 1974, pages 658–674; R. V. Garver, "Broad-Band Diode Phase Shifters," IEEE Transactions on Microwave Theory and Techniques, Vol. MTT-20, No. 5, May 1972, Pages 314–323.

One of the undesirable characteristics of the hybrid coupled diode phase shifter is the unbalance in the insertion loss as the diodes are switched between the phase states. This unbalance results from the difference in loss produced by the diodes in the conducting state ("on") and the non-conducting state ("off"). The insertion loss is a measure of the change in power (amplitude) between the RF input and output of the phase shifter. It is desirable that the amplitude of the output be the same as that of the input and thus the difference in insertion loss between the diode switching states be zero. A phase shifter having substantially equal insertion loss between the phase shifter states is desirable for wide frequency band operation and small phase and amplitude errors for more accurately steering the antenna beam in the radar system.

SUMMARY OF THE INVENTION

According to the present invention, an amplitude balanced phase shifter for selectively introducing a predetermined phase shift in a microwave frequency signal is provided. The phase shifter is of the reflection type including a pair of transmission lines of substantially equal length, the lengths being a function of the signal wavelength and at least one quarter wavelength long. The pair of transmission lines are interconnected by at least two branch transmission lines approximately one quarter wavelength apart and of the order of one quarter wavelength long. An RF input and an RF output terminal are connected to one extremity of the pair of the transmission lines, respectively. Switching means are connected to the other extremity of the transmission lines for switching each of the transmission lines from an open termination to a shorter termination. Included is means for biasing the switching means by a first voltage in a first direction and then by a second voltage in a reverse direction whereby the reflection coefficient phase angle shifts substantially a given amount providing a given amount of phase shift of the microwave signal. A first and second insertion loss is produced at the first and second bias voltages, respectively. The phase shifter further includes resistive means disposed on each of the pair of transmission lines at a spacing approximately one quarter wavelength from the switching means. At the first bias voltage the resistive means is decoupled from the RF power and at the second bias voltage the resistive means is coupled to the RF power at a predetermined value to attenuate the power, whereby the difference in the insertion loss over a predetermined frequency range at the first and second bias voltages is negligible.

DETAILED DESCRIPTION OF THE PREFERRED EMBODIMENT

Figure 1:
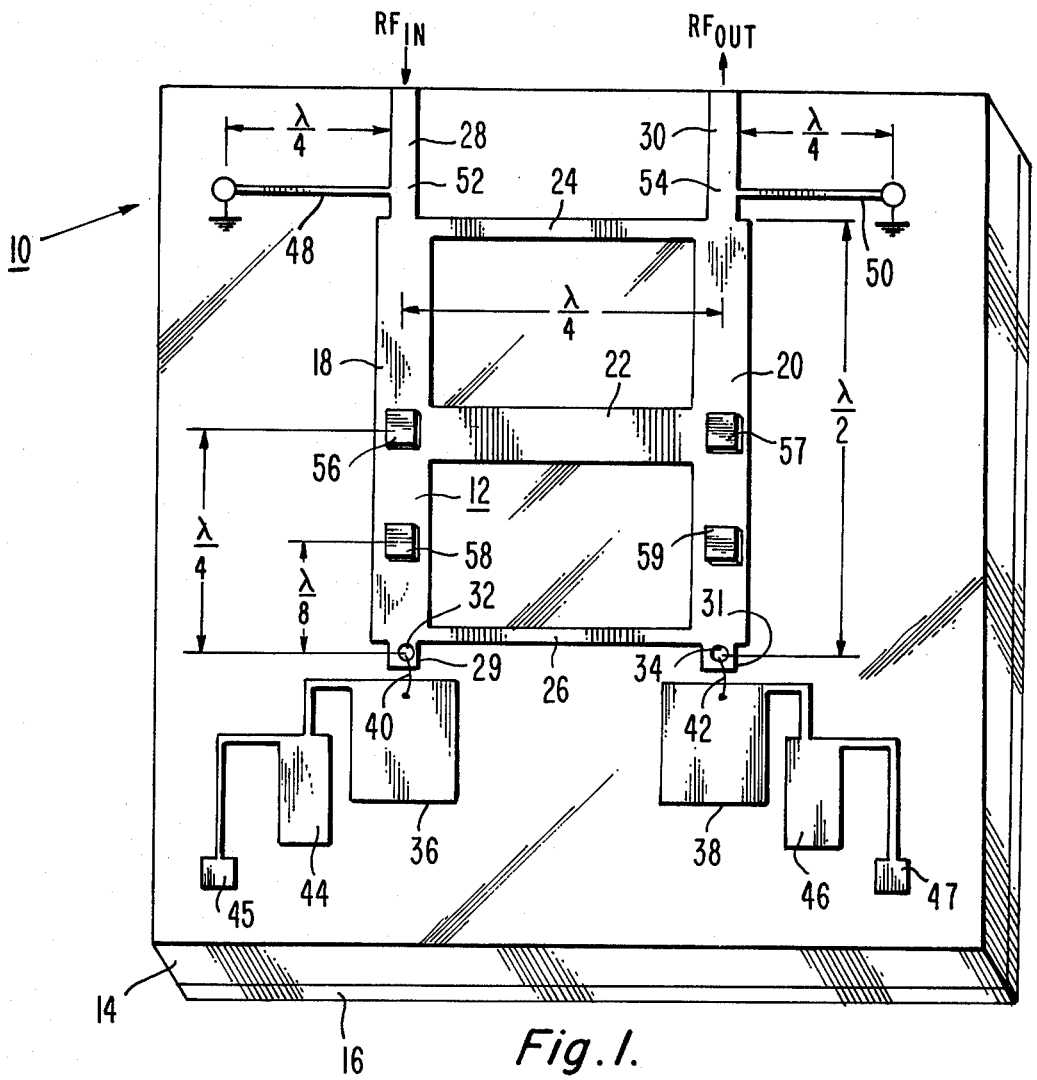
FIG. 1 is a pictorial representation of an embodiment of a microwave phase shifter of the present invention.

Referring to the drawing, there is shown in FIG. 1 a pictorial representation of one embodiment of a hybrid coupled phase shifter 10 constructed according to the present invention to provide a phase shift of 180° at microwave frequencies of operation. The fabrication of the electrical circuit of phase shifter 10 is in the form of the well known symmetrical four port network. The electrical network is preferably of the conventional microstrip construction including a pattern 12 of narrow conductors on one broad surface of a dielectric substrate 14 and a ground plane 16 of electrically conductive material on the opposite broad surface of substrate 14. Pattern 12 is typically a thin layer of conductive material formed by well known techniques, such as thin film deposition, and etched utilizing conventional resist methods to a desired configuration. In the preferred embodiment, pattern 12 and ground plane 16 are formed of copper and dielectric substrate 14 is formed of alumina ceramic, although other materials having suitable properties for these purposes may also be used.

Pattern 12 in microstrip circuit form comprises a pair of transmission lines 18 and 20 interconnected at their center points by a branch transmission line 22 having approximately the same width as lines 18 and 20, and interconnected at their respective extremities by narrower branch transmission lines 24 and 26. In this three branch line phase shifter, branch transmission lines 22, 24 and 26 are approximately one-quarter wavelength long at the center frequency of operation, and transmission lines 18 and 20 are approximately one-half wavelength long. The width of the transmission lines 18 and 20 and the branch transmission lines 22, 24 and 26 are determined by well known calculations to provide the desired characteristic impedance of the circuit. Although described herein as a three branch line device, phase shifter 10 may comprise any number of branch transmission lines with a minimum of two branches, each branch transmission line being of the order of one-quarter wavelength long and spaced approximately one quarter wavelength apart. Transmission lines 18 and 20 may be any length as a function of the wavelength at the center frequency of operation with a minimum length on the order of one-quarter wavelength.

Transmission lines 28 and 30 are connected to one extremity of the pair of transmission lines 18 and 20, lines 28 and 30 serving as RF input and output terminals, respectively. Connected to terminals 29 and 31 at the other extremity of transmission lines 18 and 20 are a pair of PIN diodes 34 and 34. Diodes 32 and 34 are utilized to provide an open or shorted termination to the transmission lines 18 and 20 by suitable DC bias voltages. PIN type diodes are well known in the art and are preferable for phase shifter applications due to their superior high-frequency characteristics. Other diodes or switching elements may, however, be used to achieve the switching of the transmission lines 18 and 20 to the desired terminations.

Diode phase circuits 36 and 38 are arranged to provide predetermined impedance conditions to diodes 32 and 34 for the desired short or open transmission line termination. The geometric configuration of circuits 36 and 38 are determined by the value of the impedance desired for diodes 32 and 34 and the desired phase shift. Circuits 36 and 38 are connected to diodes 32 and 34 by leads 40 and 42, respectively. A DC bias or video voltage is applied to diodes 32 and 34 through biasing circuits 44 and 46 at terminals 45 and 47, respectively, by a voltage source, not shown.

Isolation of the RF signal paths from the DC voltage of the diode biasing is provided by quaterwave sections 48 and 50. Sections 48 and 50 are grounded and, at RF frequencies, quarter wavelength sections 48 and 50 present a short circuit to ground and thereby high impedances at points 52 and 54. In this manner, RF energy propagating in the arms of the hybrid coupled phase shifter 10 is not affected by the biasing circuit voltage since the latter is decoupled by the high impedances.

Mounted on transmission lines 18 and 20 and preferably secured as by cementing are pads 56, 57, 58 and 59 of highly resistive material. As will be explained subsequently, pads 56, 57, 58 and 59 provide a phase shifter of balanced insertion loss as the PIN diodes 32 and 34 are switched between the conducting and non-conducting states. Pads 56 and 57 are disposed respectively approximately one quarter wavelength from diodes 32 and 34 and pads 58 and 59 one-eighth wavelength as will be discussed in detail.

The operation of this hybrid coupled phase shifter is well known and will, therefore, be discussed only briefly here. When an RF signal is applied at input terminal 28, the incident power is equally divided between transmission lines 18 and 20 and a pair of signals appears at terminals 19 and 31 opposite the input terminal 28 in quadrature phase. The reactances due to the "on" and "off" states of the PIN diodes 32 and 34 at terminals 29 and 31 reflect almost all the power, which is summed at terminal 30 where the power exits. The "on" and "off" states of diodes 32 and 34 are controlled by rendering the diodes conductive by, for example, forward biasing diodes 32 and 34 and then rendering the diodes non-conductive by reverse biasing diodes 32 and 34. Phase shift results both from the reactance switching of the diode capacitance and the resultant rerouting of the microwave currents through circuits containing the diodes 32 and 34. The amount of phase shift generated by a hybrid coupled phase shifter is equal to the difference of the angle of the reflection coefficient presented to terminals 29 and 31 by the two states of the diode networks. When diodes 32 and 34 are switched from a first reactance to a second reactance, the reflection coefficient phase angle shifts from $\theta_1$ to $\theta_2$ for a phase shift of $\theta_2 - \theta_1$, where $\theta_1$ is the phase shift at first voltage $V_1$ and $\theta_2$ is the phase shift at second voltage $V_2$.

Figure 2:
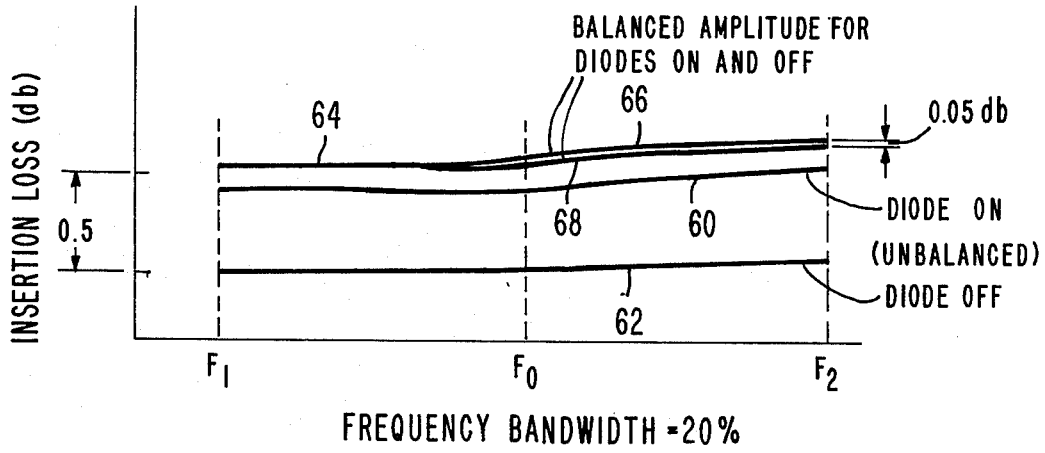
FIG. 2 is a graph of the phase shifter insertion loss versus frequency utilized in describing the present invention.

At the conducting and non-conducting states of diodes in the known prior art phase shifters, the insertion loss produced as a result of diode switching differs for each state. This difference in insertion loss is due in part to the different impedance conditions of the diodes as they are switched on and off. As shown in FIG. 2, the difference in insertion loss as a function of frequency of a typical prior art hybrid phase shifter is on the order of 0.5 db or higher between the diode on and off conditions as shown by curves 60 and 62, respectively. In general, these prior art devices are capable of maintaining the difference in insertion loss between the diode switching states to $\pm 0.3$ db and often the insertion loss of the device is measured in terms of an average loss. Since the insertion loss is a measure of the change in power between the RF input and output of the phase shifter, it is desirable that the difference in insertion loss or power change between the states be zero. A substantially equal insertion loss at the on and off diode conditions will result in less phase and amplitude errors for more accurately steering the antenna beam in a radar system. Of course, it is ideal to have a phase shifter which will produce little or no insertion loss but since there will usually be mismatches of impedances between the circuit elements of electrical systems, a certain amount of insertion loss will result. Balancing the insertion losses, however, at the conducting and non-conducting diode states will provide a phase shifter of improved accuracy as described herein.

According to the invention, as hereinbefore discussed, pads 56, 57, 58 and 59 of highly resistive material are disposed on transmission lines 18 and 20 as shown in FIG. 1, to provide energy absorbers for balancing the insertion loss between the diode states. (See, for example, U.S. Pat. No. 3,585,533 issued on June 15, 1971, describing a microwave device with a resistive high frequency energy absorber.) In the embodiment shown for a 180° phase shifter operating at S-band, pads 56, 57, 58 and 59 are formed of resistive material sold under the tradename "Eccosorb" and manufactured by Emerson and Cuming Inc., 59M Walpole St., Canton, MA. "Eccosorb" is a resonant, flexible, silicone rubberbased, high dielectric and high permeability energy absorbent material. In the preferred embodiment, pads 56, 57, 58 and 59 are squares having sides of 0.080 inch (0.203 cm.) and a thickness of 0.067 inch (0.170 cm.). Other shapes and dimensions may be utilized depending upon the operating conditions and the desired resistance to be achieved by the resistive material.

Pads 56 and 57 are disposed on transmission lines 18 and 20 approximately one-quarter wavelength from diodes 32 and 34. It is believed, as is understood in the present state of the art, that when diodes 32 and 34, which are in series, are biased to make them conductive, there is a voltage minimum at diodes 32 and 34 across the circuit to ground as energy reflects along transmission lines 18 and 20. At the position of pads 56 and 57 on transmission lines 18 and 20 one quarter wavelength from diodes 32 and 34, the circuit voltage is at a maximum and current at a minimum. The resistance of pads 56 and 57 cemented on the surface of the transmission lines (not across) is thus not coupled to the circuit and energy is not absorbed. When diodes 32 and 34 are biased to a non-conducting condition, the diodes are open. At this "off" diode condition, there is a maximum voltage at diodes 32 and 34 and a minimum voltage and maximum current at pads 56 and 57. At this state, pads 56 and 57 absorb reflected energy and attenuate the power, and for the particular embodiment described herein, the power attenuation is of the order of 0.5 db. If pads 56 and 57 are slid toward the maximum voltage and minimum current at diodes 32 and 34 when there is a minimum voltage at one quarter wavelength, less energy can be absorbed and control of the energy attenuation to a desired sensitivity can be achieved. The effect of the energy absorbing pads being coupled or de-coupled from the reflective circuit is to balance the insertion loss at the diode switching states. As shown in FIG. 2, for a significant portion of the frequency range of $F_1$ to $F_2$, indicated by curve 64, the range $F_1$ to $F_2$ representing a bandwidth of about 20% at S-band, the difference in the insertion loss between the diode switching states is zero. Over the balance of the frequency range at the higher frequency level, the difference in insertion loss is negligible, typically on the order of 0.05 db as shown by curves 66 and 68. While the difference in insertion loss between the diode switching states is substantially balanced in accordance with the invention, the absolute value of the insertion loss is increased by an amount of about 0.1 db over unbalanced phase shifting devices at S-band frequencies. For this reason, the invention is preferable in phase shifting applications of low power level, such as, for example, 100 watts average or less, to minimize potential harmful effects due to excessive heat dissipation. However, in systems employing adequate cooling controls, the invention may also be utilized for high power to balance the insertion loss without causing deleterious effects due to excessive heat.

In accordance with a preferred embodiment of the invention, additional resistive pads 58 and 59 (FIG. 1) are disposed on transmission lines 18 and 20 at a location approximately one-eighth wavelength from diodes 32 and 34. Pads 58 and 59 compliment pads 56 and 57 in the attenuation of energy, increasing the sensitivity as to the amount of resistance which can be coupled to the circuit. Hence energy absorbed is over a broader bandwidth at the expense, however, of increasing further the above-mentioned additional 0.1 db insertion loss.

Although the invention has been described in the embodiment of a 180° phase shifter operating at S-band, it should be appreciated that the invention is not limited by frequency or phase shift angle. The invention is applicable to a single or multi-bit phase shifter to provide a phase shift of various angles according to the desired parameters and circuit configuration. Also, the invention may be implemented in transmission lines other than the hereinbefore described microstrip circuit such as, coaxial, stripline, or waveguide transmission lines. In the coaxial line, an absorber may be cemented along the center or outer conductor. In stripline, a thin film deposit of resistive material may be located on the center conductor. In waveguide form, resistive material may be located on the walls of the waveguide to control the energy attenuation.

What is claimed is:

1. A phase shifter for selectively introducing a predetermined phase shift in a microwave frequency signal, said phase shifter being of the reflection type including a pair of transmission lines of substantially equal length, the length of each transmission line being a function of the signal wavelength and at least one quarter wavelength long, said pair of lines being interconnected by at least two branch transmission lines approximately one quarter wavelength apart and of the order of one quarter wavelength in length, an RF input terminal and an RF output terminal connected to one extremity of said pair of transmission lines, respectively, switching means connected to the other extremity of said pair of transmission lines for switching each of said transmission lines from an open termination to a shorted termination, means for biasing said switching means by a first voltage in a first direction and then by a second voltage in a reverse direction whereby the reflection coefficient phase angle shifts substantially a given amount providing a given amount of phase shift of said microwave frequency signal and whereby a first and second insertion loss is produced at said first and second bias voltages respectively, wherein the improvement comprises:

resistive means disposed on each of said pair of transmission lines at a spacing approximately one quarter wavelength from said switching means such that at said first bias voltage said resistive means is decoupled from said RF power and at said second bias voltage said resistive means is coupled to said RF power at a predetermined value to attenuate said power, whereby the difference in the insertion loss over a predetermined frequency range at said first and second bias voltages is negligible.

2. A phase shifter according to claim 1, wherein said switching means includes a PIN diode.

3. A phase shifter according to claim 1, wherein the length of the pair of transmission lines is of the order of one half wavelength, said pair of transmission lines being interconnected by three branch transmission lines, one branch transmission line interconnecting the center of said pair of transmission lines, the other two branch lines interconnecting the extremities of said pair of transmission lines.

4. A phase shifter according to claim 1, further including second resistive means disposed on each of said pair of transmission lines at a spacing approximately one eighth wavelength from said switching means.

5. A phase shifter according to claim 1, wherein said pair of transmission lines and said branch transmission are microstrip transmission lines including a pattern of narrow conductors on one broad surface of a dielectric substrate and a single ground conductor on the opposite broad surface of said substrate.

6. A phase shifter according to claim 1, wherein said predetermined phase shift is of the order of 180°.

* * * * *